United States Patent [19]

Roccaforte

[11] Patent Number: 4,546,914

[45] **Date of Patent: * Oct. 15, 1985**

[54] INTEGRAL THREE-PLY STRAP HANDLE

[75] Inventor: Harry I. Roccaforte, Western Springs, Ill.

[73] Assignee: Champion International Corporation, Stamford, Conn.

[ * ] Notice: The portion of the term of this patent subsequent to Apr. 5, 2000 has been disclaimed.

[21] Appl. No.: 532,836

[22] Filed: Sep. 16, 1983

[51] Int. Cl.[4] ..... B65D 5/46

[52] U.S. Cl. ..... 229/52 B; 206/427; 206/141

[58] Field of Search ..... 229/52 B, 40; 206/427, 206/434, 141

[56] References Cited

U.S. PATENT DOCUMENTS

| | | | |
|---|---|---|---|
| 2,723,027 | 11/1955 | Guyer | 229/52 B X |
| 2,797,856 | 7/1957 | Jaeschke | 229/52 B |
| 2,868,433 | 1/1959 | Anderson, Jr. | 229/52 B |
| 2,955,739 | 10/1960 | Collura | 229/52 B |
| 3,094,268 | 6/1963 | Swanson et al. | 229/52 B |
| 3,112,856 | 12/1963 | MacIntosh et al. | 229/52 B |
| 3,353,709 | 11/1967 | Lawrence | 206/141 |
| 3,994,432 | 11/1976 | Kirby, Jr. | 229/52 B |
| 4,378,905 | 4/1983 | Roccaforte | 229/52 B |

FOREIGN PATENT DOCUMENTS

| | | | |
|---|---|---|---|
| 874282 | 6/1971 | Canada | 229/17 B |

*Primary Examiner*—William T. Dixson, Jr.
*Assistant Examiner*—Gary E. Elkins
*Attorney, Agent, or Firm*—Evelyn M. Sommer

[57] ABSTRACT

A carton has a handle formed on its top. The carton comprises top and bottom walls connected by a tubular body. The top wall has inner and outer panels extending from opposite sides of said tubular body and being overlapped and having portions secured together. An integral, reinforced, three-ply elongated handle panel is formed from a portion of the outer top panel twice bent back upon itself, and is substantially equally spaced from the tubular body opposite sides. A cut and perforated scoreline is formed in the outer top panel to define the handle panel, which scoreline has a midsection partially parallel to a free end edge of the outer top panel and has flared end portions joined to the midsection for added strength at its joinder to the tubular body. This handle panel lies flat against the top wall of the carton while it is shipped and stored, and is readily accessible by lifting along the scoreline. An opening is also formed in the inner top wall panel to provide clearance for fingers to be positioned beneath the handle panel so the panel can be lifted to free the panel for use. A printed portion simulating a second opening can be provided on the outer top wall panel adjacent the handle panel opposite the finger opening to aid the user in positioning his fingers properly to grasp beneath and pull the handle panel to a use position.

6 Claims, 8 Drawing Figures

INTEGRAL THREE-PLY STRAP HANDLE

BACKGROUND OF THE INVENTION

1. Field of the Invention

The present invention relates to a carton having an integral handle formed on its top wall, and a blank for forming the carton. More particularly, the invention relates to an improved, three-ply reinforced handle arrangement which is centrally located on the carton top wall, is aligned with the carton center of gravity, and can be easily separated from the carton top wall along a scoreline.

2. Description of the Prior Art

Cartons or containers for large quantities of consumer articles are often provided with a handle to facilitate carrying the carton with its contents. Preferably, this handle is formed from a unitary portion of the blank used to form the reminder of the carton to simplify construction of the carton and to minimize expenses. For cartons containing relatively heavy articles, such as cans of beer or other beverages, the carton must be sufficiently strong to withstand the considerably weight of the carton and its contents.

In one known carton, the handle comprises two U-shaped panels which overlie one another and extend angularly outwardly from one of the top edges of the carton. Since the handle extends from an edge of the carton, it is offset from the center of gravity of the carton causing the carton to hang at an angle when held by the handle. The angular hanging of the carton makes carrying difficult and interferes with walking.

Cartons have also been provided with separate handles which comprise a strap which extends through and is affixed at its ends to the bottom of the carton top panel. Because of the load place in the carton, the handle often tears and is separated from the top panel of the carton at its ends.

Accordingly, in my previous U.S. Pat. No. 4,378,905, issued Apr. 15, 1983 to the same assignee as the present invention, I disclose a carton and a blank for forming a carton with an integral strap handle located in the center of the carton top and aligned with the carton center of gravity to distribute the load of the carton evenly when held by the handle. Since the handle is integral with the carton, it is prevented from readily tearing and separating at its ends when grasped by a user.

The carton comprised top and bottom walls which are connected by a tubular body. The top wall has inner and outer panels extending from opposite sides of the tubular body, which panels are overlapped and secured together. An elongated handle panel is formed from a doubled back end portion of the outer top panel and is substantially equally spaced from the tubular body opposite sides. The handle panel is defined by a scoreline formed in the outer top panel which extends substantially parallel to a free end edge of the outer top panel and at least to the tubular body, which is grasped and pulled upwardly to sever the scoreline.

Since the handle is formed from a doubled back end portion of the outer top wall panel, the carton may be completely sealed. The scoreline holds the handle flat against the carton to facilitate shipping and storage, while permitting the handle to be readily accessible to the consumer by merely tearing along the scroreline.

However, the handle had to be reinforced by the insertion of a reinforcement tape between the scoreline and hinge upon which it was doubled back upon itself or by the inclusion of a strip of reinforcement tape beneath the doubled back end portion of the outer handle panel to provide rigidity to the handle and preclude it from being torn at its ends from the handle body.

Furthermore, because the outer top panel is sealed to a portion of the inner top panel and the handle lies flat against the inner top panel, the fingers may not be readily inserted beneath the strap handle between the inner and outer top panels to grasp and pull the handle panel upwardly to sever the connecting scoreline enabling the handle panel to be used to carry the carton.

The present invention relates to an improved structure of such an integral strap handle which dispenses with the necessity of providing a separate reinforcing element or tape and readily enables a user to grasp and sever the handle from the top panel.

SUMMARY OF THE INVENTION

In accordance with this invention, an opening is formed in the inner top wall panel to provide clearance for fingers to be positioned beneath the handle panel so the panel can be lifted to sever the scoreline to free the panel for use. A printed portion simulating a second opening can be provided on the outer top wall panel adjacent the handle panel opposite the finger opening to aid the user in positioning his fingers properly to grasp beneath and pull the handle panel to a use position.

The scoreline formed in the outer top panel to define the handle panel is also provided with a midportion extending substantially parallel to a free end edge of the outer top panel. However, the end portions of the scoreline are flared away from the free edge to provide a wider juncture area of the strap to the carton at the points where the greatest load is concentrated.

Finally, the handle is reinforced and stiffened by providing an additional panel to form the end of the outer top panel which is twice bent back upon itself before the outer top panel is sealed to the inner top panel. The additional reinforcement panel, which is adhesively secured to an end portion of the outer top panel forming the handle construction, enables the strap handle to consist of three, rather than two plies, and removes the necessity of providing a separate reinforcement tape to strengthen and stiffen the handle.

BRIEF DESCRIPTION OF THE DRAWINGS

Further objects and advantages of the invention will become apparent from the following specification and claims, and from the accompanying drawings, wherein:

DETAILED DESCRIPTION OF THE PREFERRED EMBODIMENT

Figure 1:
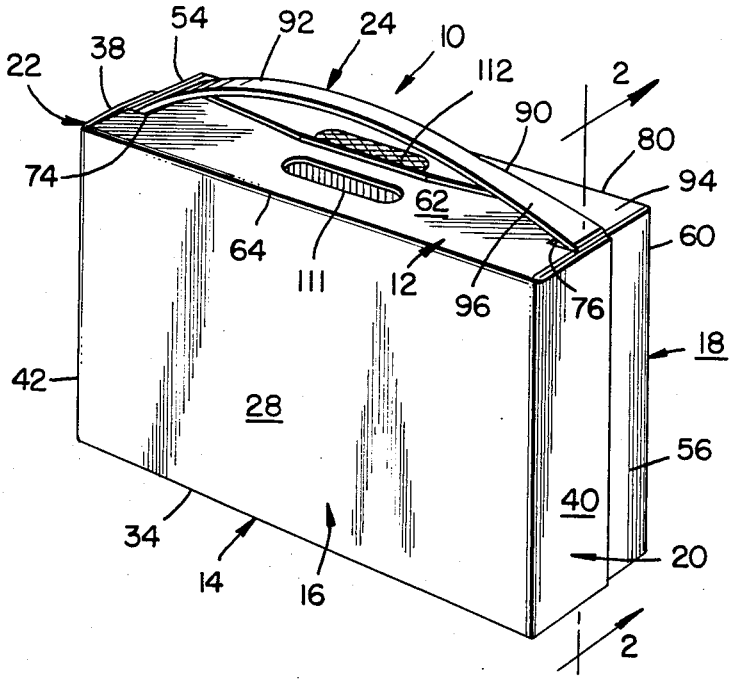
FIG. 1 is a perspective view illustrating the carton of the present invention with its handle in an operative position.

Referring to FIG. 1, carton 10 in its assembled configuration has a top wall 12, a bottom wall 14, a front wall 16, a back wall 18 and two side walls 20, 22. These walls are rectangular in shape to define a rectangular parallelepiped and are coupled along their adjacent edges.

An elongated handle panel 24 is provided on top wall 12 and extends parallel to front and back walls 16, 18 and perpendicular to side walls 20, 22. Handle panel 24 is centered on top wall 12 in that it is substantially equally spaced from front and back walls 16, 18. The longitudinal axis of handle panel 24 lies in a plane parallel to front and back walls 16, 18 and containing the center of gravity of carton 10.

Figure 4:
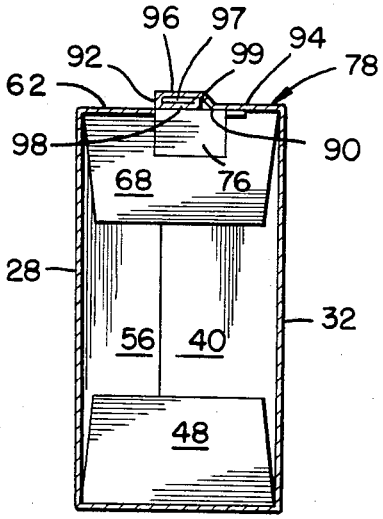
FIG. 4 is a cross-sectional view taken substantially along the plane indicated by line 4—4 of FIG. 2.
Figure 2:
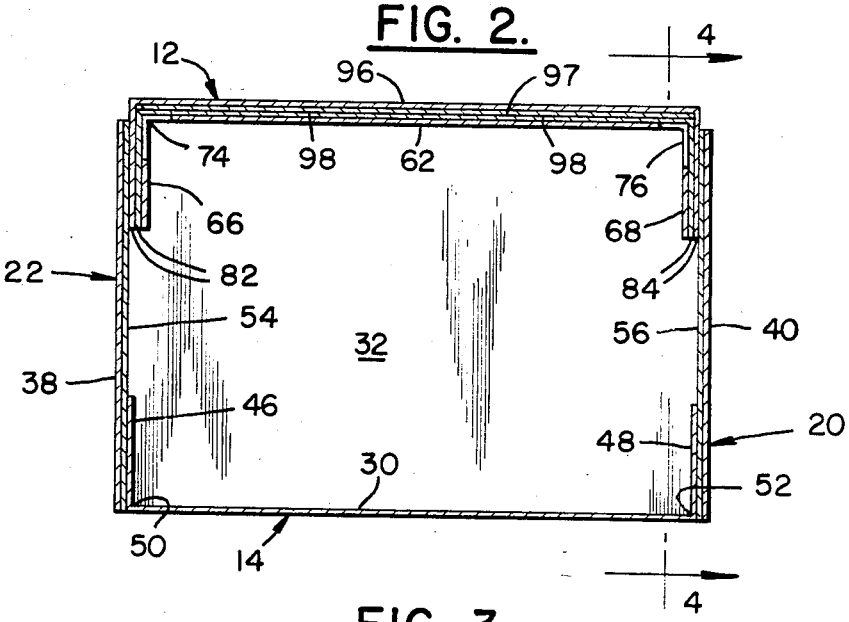
FIG. 2 is a cross-sectional view taken substantially along the plane indicated by line 2—2 of FIG. 1, but with the carton handle in a stored position.
Figure 3:
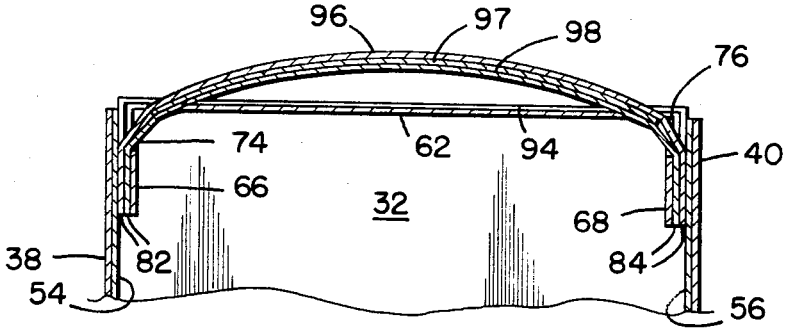
FIG. 3 is a view similar to FIG. 2, but with the handle in its operative position.
Figure 7:
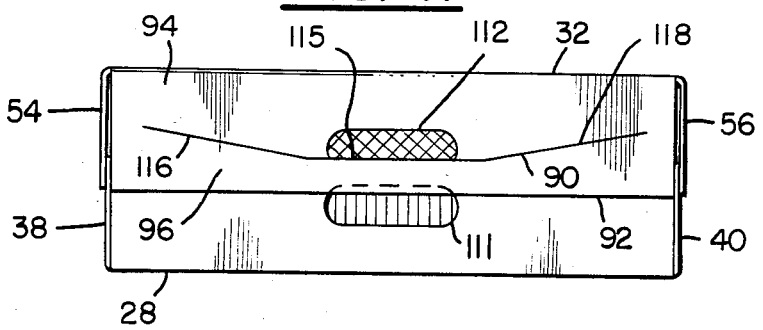
FIG. 7 is a top plan view of the finished folded and sealed top of the blank of FIG. 5.

To facilitate storage and shipping, handle panel 24 initially lies flat against top wall 12 as illustrated in FIGS. 2, 4 and 7. When the consumer needs to carry carton 10 by handle panel 24, the consumer separates handle panel 24 from the remainder of top wall 12 as illustrated in FIGS. 1 and 3, by pulling upwardly on panel 24.

Figure 5:
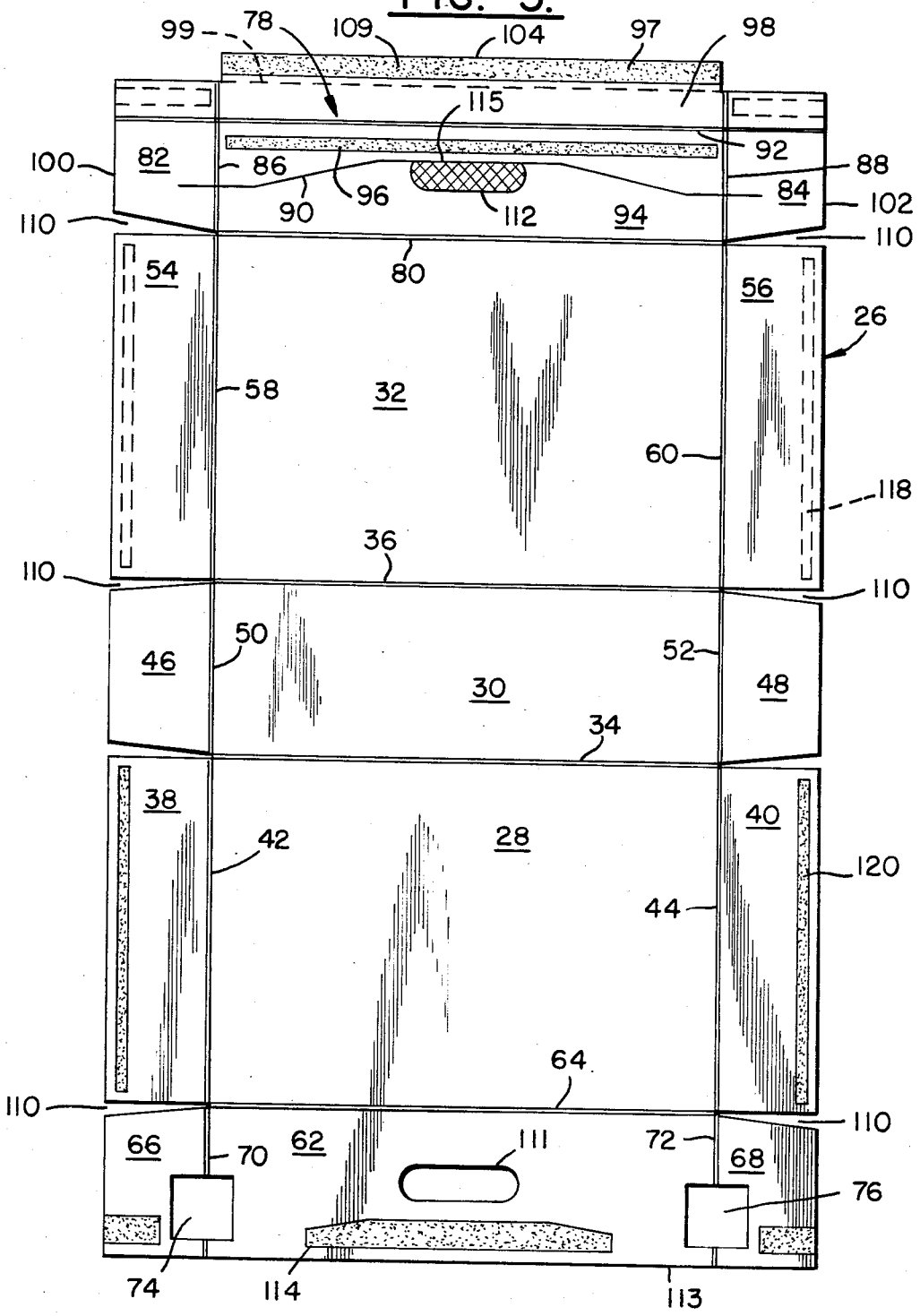
FIG. 5 is a plan view of a blank used to form the carton of FIG. 1.

A planar, unitary blank 26 for forming carton 10 is illustrated in FIG. 5. Blank 26 can be formed of a unitary piece of paperboard of suitable weight and thickness. The weight and thickness of the paperboard depends on the size and weight of the articles contained within carton 10. FIG. 5 illustrates the surface of blank 26 which will form the interior surface of carton 10 illustrated in FIG. 1.

The central portion of blank 26 comprises a front panel 28, a bottom panel 30 and a back panel 32. Each of these panels are rectangular, with panels 28, 32 being equal in size. Front and back panels 28, 32 are hingedly coupled to bottom panel 30 at opposite end edges thereof along fold lines 34, 36, respectively.

Front panel 28 has first and second rectangular side flaps 38, 40 hingedly coupled at its opposite side edges along fold lines 42, 44, respectively. Bottom panel 30 has first and second rectangular side flaps 46, 48 hingedly coupled at its opposite side edges along fold lines 50, 52, respectively. Similarly, back panel 32 has first and second rectangular side flaps 54, 56 hingedly coupled to its opposite side edges along fold lines 58, 60, respectively.

A generally rectangular inner top panel 62 is hingedly coupled at an end edge of front panel 28 remote from bottom panel 30 along a fold line 64. First and second generally rectangular side flaps 68, 66 are hingedly coupled at opposite side edges of inner top panel 62 along fold lines 70, 72. Rectangular openings 74, 76 are formed in inner top panel 62 and its side flaps 66, 68 such that openings 74, 76 span fold lines 70, 72, respectively.

A rectangular outer top panel 78 is hingedly coupled at an end edge of back panel 32 remote from bottom panel 30 along a fold line 80. First and second rectangular side flaps 82, 84 are hingedly coupled at opposite side edges of outer top panel 78 along fold lines 86, 88, respectively.

Outer top panel 78 is divided into three panels by a cut and perforated score line 90 and a fold line 92 to define an outer top wall panel 94, an outer handle panel 96 and a first inner handle panel 98. A second inner or handle reinforcement panel 97 is foldably connected to handle panel 98 by a serrated or perforated score line 99. Each of these panels is rectangular. Score line 90 comprises a cut and perforated line in the material of blank 26 which has a mid portion parallel to fold line 92 and end portions which diverge away therefrom at an acute angle. Score line 90 extends entirely across outer top panel 78 terminating in side flaps 82, 84 between fold lines 86, 88 and the free edges 100, 102 of side flaps 82, 84 remotely from top outer panel 78. Fold line 92 extends entirely across outer top panel 78 and side flaps 82, 84, parallel to the mid portion of score line 90 and between score line 90 and free end edge 104 of outer top panel 78.

Adjacent side flaps are separated by cut out portions 110 to permit the side flaps to be folded independently of one another. Respective pairs of cut out portions 110 are formed colinearly with each of the fold lines 34, 36, 64, 80.

Figure 6:
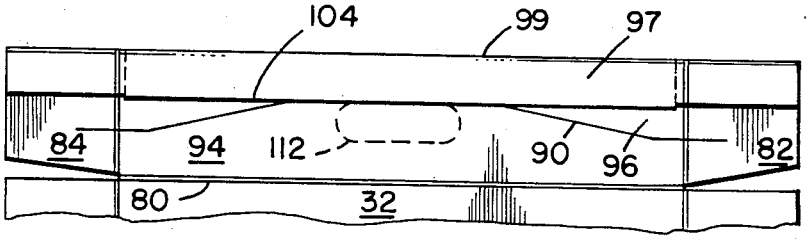
FIG. 6 is a partial plan view of the top of the blank of FIG. 5, partially folded to form the carton of the present invention.
Figure 8:
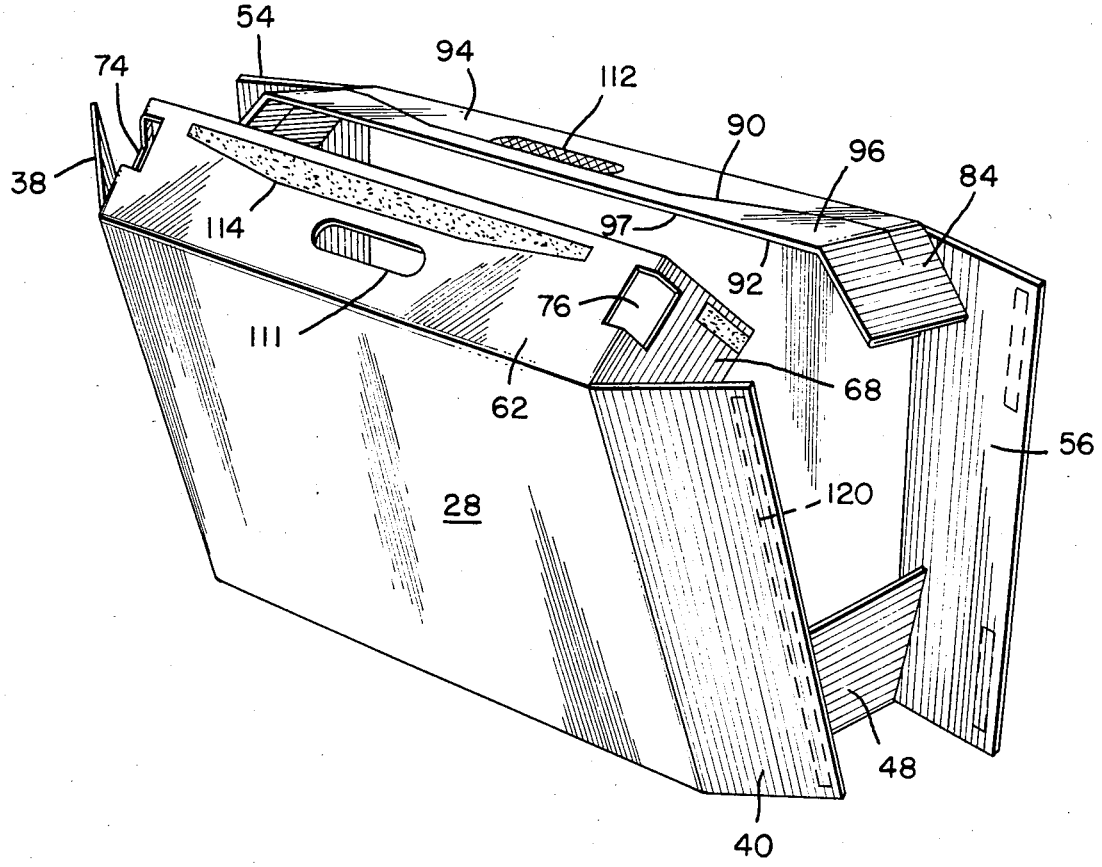
FIG. 8 is a perspective view of a partially folded blank of FIG. 5, illustrating the manner of erecting the carton of FIGS. 1 to 4.

Carton 10 is formed from blank 26 illustrated in FIG. 5. Handle reinforcement panel 97 is first folded 180° along perforated score line 99 and adhered by adhesive 109 to inner handle panel 98 as shown in FIG. 6. Inner handle panel 98 is then folded 180° about line 92 so that panel 97 overlies the interior surface of outer handle panel 96, to form a twice folded, three ply handle panel 24 (see FIG. 4). An adhesive is applied to reinforcement handle panel 97 in area 109 adjacent free end edge 104 to adhere reinforcement handle panel 97 to outer handle panel 96. Panels 28, 62 and flaps 38, 40, 66, 68 are then folded about line 34 to overlie the interior surfaces of panels 30, 32 and flaps 46, 48, 54, 56. Thereafter, out top panel 78 is folded about line 80 to overlie the exterior surface of inner top panel 62 with handle panel 24 overlying openings 74, 76, as shown in FIGS. 7 and 8. Panel 62 is attached to the interior surface of wall panel 94 and side flaps 66, 68 are attached to side flaps 82, 84, respectively, by an adhesive applied to the area 114 on the exterior surfaces of panel 62 along the inner edge of an elongated opening 111 cut in inner top panel 62 midway between scorelines 70, 72 and scoreline 64 and free edge 113. Adhesive 114 is located between side flaps 66, 68 adjacent free edge 113 and also on side flaps 66 and 68 as shown in FIG. 5. Blank 26 is now in a partially assembled, collapsed condition of carton 10 in which it may be easily and efficiently shipped and stored.

Immediately prior to filling the carton, panels 78, 32, 30, 28, 62 are folded about lines 80, 36, 34, 64 to form a tube of rectangular cross section which is open at its ends. Once blank 26 has been formed into a tube, one side can be closed and the carton filled with the desired contents, the other side being closed after filling. Alternatively, both sides can be closed simultaneously or sequentially after the carton has been packed.

Since the folding of blank 26 to close each side of the partially assembled carton is similar, only the closing of one side will be described in detail. Side flaps 84, 68 are folded about lines 88, 72, respectively, until they depend perpendicularly from top panels 78, 62. Side flap 48 is folded about line 52 until it extends perpendicularly upwardly from bottom panel 30. Side flap 56 is then folded about line 60 to overlie outer top panel side flap 84 and bottom side flap 48, and is adhered thereto by adhesive applied to areas 118 on the interior surface of side flap 56. Thereafter, side flap 40 is folded about line 44 to overlie side flap 56 and side flaps 84, 48, as illustrated in FIGS. 1 and 8, and is adhered thereto by adhesive applied to areas 120 on the interior surface of side flap 40.

The other side of carton 10 is folded in a similar manner. In this manner, top panels 62, 78 form top wall 12, bottom panel 30 forms bottom wall 14, front panel 28 forms front wall 16, back panel 32 forms back wall 18, side flaps 40, 48, 56, 68, 84 form side wall 20, and side flaps 38, 46, 54, 66, 82 form side wall 22.

During shipping and storage of carton 10, score line 90 remains intact and retains handle panel 24 in place flat against inner top panel 62 as illustrated in FIGS. 2 and 4. When the consumer needs to use handle panel 24 (i.e., handle panels 96, 97 and 98) to carry carton 10, the handle panel is severed from the remaining portion of outer top panel 78 (i.e., wall panel 94) along score line 90. Opening 111 formed in the inner top wall panel 62 provides clearance for fingers to be positioned beneath the handle panel 24 so the panel can be lifted to sever the score line 90 to free the panel 24 for use. A printed portion 112 simulating a second opening can be provided on the outer top wall panel 94 adjacent the handle panel 24 opposite the finger opening 111 to aid the user in positioning his fingers properly to grasp beneath and pull the handle panel 24 to a use position. This permits the consumer to lift carton 10 upwardly in a plane of the center of gravity of carton 10 such that carton 10 will hang down vertically and evenly under its weight from the consumer's hand without bumping into the consumer's leg.

Since score line 90 extends downwardly beyond the corners between top wall 12 and side walls 20, 22 and the side flaps 82, 84 are adhered to side flaps 56, 54, the stresses at the ends of handle panel 24 will be in a vertical direction, rather than in a horizontal direction. Thus, the stresses in handle panel 24 subject handle panel 24 to tension forces, rather than shear forces, to maximize the load carrying capacity of the handle panel.

The handle panel is strengthened by the triple thickness of paperboard formed by inner and outer handle panels 98, 96 and by reinforcing panel 97.

The score line 90 formed in the outer top panel 96 to define the handle panel 24 can be provided with a midportion 115 extending substantially parallel to a free end edge 92 of the outer top panel 96. However, the end portions 116, 118 of the scoreline are flared away from the free edge 92 (see FIG. 7) to provide a wider area at the juncture of the strap to the carton at the points where the greatest load is concentrated, which precludes the necessity of using a reinforcement tape or the like adjacent the ends of the strap handle panel 24.

By forming openings 74, 76 in inner top panel 62 and side flaps 66, 68 aligned with handle panel 24, the ends of handle panel 24 may extend into carton 10 to contact the carton contents. For contents such as cylindrical cans, this arrangement permits the handle panel 24 to roll and bend about the cylindrical surfaces of the cans to tighten them together in a solid block and to prevent the handle from cracking at fold lines 86, 88. Although carton 10 may be formed without openings 74, 76, the ends of handle panel 24 will tend to form additional creases at the terminations of score line 90. These additional creases are disadvantageous since they tend to form cracks and handle failure.

Since the handle is formed from a folded over edge of blank 26, the carton may be completely sealed about the contents. This arrangement is advantageous for beverages since the carton functions as an insulator to maintain the beverages at a relatively low temperature.

Although the invention has been described in considerable detail with particular reference to a certain preferred embodiment thereof, variations and modifications can be effected within the spirit and scope of the invention as defined in the appended claims.

What is claimed is:

1. A carton comprising top and bottom walls;

front, back and side walls connecting said top and bottom walls;

said top wall having inner and outer panels extending from said front and back walls, respectively, and being overlapped and secured together;

first and second side flaps extending from opposite side edges of said outer top panels and secured to the inside of said side walls;

an integral portion of said outer top panel being twice bent back upon itself to form inner, intermediate and outer elongated handle panels foldably connected together, said handle panels extending substantially parallel to and equally spaced from the top edges of said front and back walls and substantially perpendicular to said side walls with at least a portion of at least one of said handle panels including a portion of said first and second side flaps;

said outer handle panel being defined by a cut score line formed in said outer top panel which extends entirely across the length of said outer top panel and includes a side portion substantially parallel to said top edges of said front and back walls and end portions which flare at an angle with respect to said mid portion and extend partially across each of said side flaps, and by handle fold line formed in said outer top panel which extends parallel to the mid portion of said score line and across the entire length of said outer top panel and said side flaps and is located between said score line and the top edge of said front wall;

said inner handle panel being defined between said handle fold line and by said cut score line of said outer top panel;

said intermediate handle panel being defined by a panel positioned between said inner and outer handle panels and between said handle fold line and said cut score line, said intermediate handle panel being foldably connected to said inner handle panel, said intermediate handle panel underlying and being secured to said outer handle panel; and wherein openings are formed in said inner top panel and said side flaps coupled thereto spanning junctures there between and underlying said handle panels.

2. A carton according to claim 1 including an elongated opening in said inner top panel adjacent to and extending under said outer handle panel.

3. A carton according to claim 1 including a printed portion on said outer top panel simulating an elongated opening therethrough.

4. A carton according to claim 1 including an elongated opening in said inner top panel adjacent to and extending under said outer handle panel, and a printed portion on said outer top panel simulating an elongated opening therethrough.

5. A carton according to claim 1 including an elongated opening in said inner top panel adjacent to and extending under said outer handle panel.

6. A carton according to claim 5 including a printed portion on said outer top panel simulating an elongated opening therethrough.

* * * * *